US012644251B2

(12) United States Patent
Vahling

(10) Patent No.: US 12,644,251 B2
(45) Date of Patent: Jun. 2, 2026

(54) MACHINE INCLUDING IMPLEMENT LINKAGES WITH BUMP STOPS

(71) Applicant: Caterpillar Inc., Peoria, IL (US)

(72) Inventor: Bruce Raymond Vahling, Urbana, IL (US)

(73) Assignee: Caterpillar Inc., Peoria, IL (US)

( * ) Notice: Subject to any disclaimer, the term of this patent is extended or adjusted under 35 U.S.C. 154(b) by 404 days.

(21) Appl. No.: 18/335,173

(22) Filed: Jun. 15, 2023

(65) Prior Publication Data

US 2024/0417949 A1 Dec. 19, 2024

(51) Int. Cl.

| | |
|---|---|
| ***E02F 3/76*** | (2006.01) |
| ***E02F 3/815*** | (2006.01) |
| ***E02F 5/32*** | (2006.01) |

(52) U.S. Cl.

CPC ..... *E02F 3/8157* (2013.01); *E02F 5/32* (2013.01); *E02F 3/7604* (2013.01)

(58) Field of Classification Search

CPC ..... E02F 3/7604; E02F 3/8157; E02F 5/32
See application file for complete search history.

(56) References Cited

U.S. PATENT DOCUMENTS

| | | | | |
|---|---|---|---|---|
| 4,081,035 A * | 3/1978 | Bowen | E02F 5/32 172/699 |
| 5,094,017 A | 3/1992 | Matsumoto et al. | |
| 2013/0264083 A1 | 10/2013 | Jorgensen et al. | |

FOREIGN PATENT DOCUMENTS

| | | | |
|---|---|---|---|
| CN | 206457868 U | 9/2017 | |
| GB | 2049383 A * | 12/1980 | E02F 5/32 |

OTHER PUBLICATIONS

A Guide to Bump Stops for Off-road Suspensions, www.timbren.com, Mar. 31, 2023, 9 pages.

* cited by examiner

*Primary Examiner* — Matthew R Buck

(57) ABSTRACT

A linkage for moving an implement between a working state and a stowed state with respect to a frame of a machine. The linkage includes a carriage, at least one arm assembly, and one or more bump stops. The carriage is configured to support the implement. The arm assembly is coupled to the carriage and is pivotable with respect to the carriage to move the implement to the stowed state. The bump stops are configured to contact an arm, of the arm assembly, in the stowed state of the implement to isolate impact stress away from the frame and onto the linkage.

20 Claims, 4 Drawing Sheets

MACHINE INCLUDING IMPLEMENT LINKAGES WITH BUMP STOPS

TECHNICAL FIELD

The present disclosure relates to a linkage that movably couples an implement to a frame of a machine. More particularly, the present disclosure relates to the linkage having bump stops that mitigate transfer of a force from the implement to the frame.

BACKGROUND

Machines, such as motor graders, generally include implements, e.g., ripper blades, to perform functions, such as a breaking and/or a loosening of a ground surface. To perform such functions, the machines may be moved over the ground surface and the implements may be made to contact and/or engage with the ground surface as the machine is moved. When such an implement is not in use, the implement may be lifted away from the ground surface to be moved to a stowed state with respect to a frame of the machine.

During operations of the implement, various forces may act on the implement. Such forces may include reactionary forces arising from the operation of the implement. Further, the implement may also be subject to forces as the implement may be moved to the stowed state (e.g., from a working state). A significant component of such forces may be transferred to the frame of the machine. As a result of such force transfer, structural stresses may be developed and/or induced in the frame and potentially in various other parts of the machine that surround the frame.

SUMMARY OF THE INVENTION

In one aspect, the disclosure relates to a linkage for moving an implement between a working state and a stowed state with respect to a frame of a machine. The linkage includes a carriage, at least one arm assembly, and one or more bump stops. The carriage is configured to support the implement. The arm assembly is coupled to the carriage and is pivotable with respect to the carriage to move the implement to the stowed state. The bump stops are configured to contact an arm, of the arm assembly, in the stowed state of the implement to isolate impact stress away from the frame and onto the linkage.

In another aspect, the disclosure is directed to a machine. The machine includes a frame and an implement coupled to the frame. The machine also includes a linkage for moving the implement between a working state and a stowed state with respect to the frame. The linkage includes a carriage, a first arm assembly, a second arm assembly, and a pair of bump stops. The carriage supports the implement. Each of the first arm assembly and the second arm assembly is coupled to the carriage and is pivotable with respect to the carriage to move the linkage to the stowed state. The pair of bump stops are configured to be in contact between the carriage and respective arms of the first arm assembly and the second arm assembly to limit, in the stowed state, further movement of the implement towards the stowed state.

DETAILED DESCRIPTION

Reference will now be made in detail to specific embodiments or features, examples of which are illustrated in the accompanying drawings. Generally, corresponding reference numbers may be used throughout the drawings to refer to the same or corresponding parts, e.g., 1, 1', 1", 101 and 201 could refer to one or more comparable components used in the same and/or different depicted embodiments.

Figure 1:
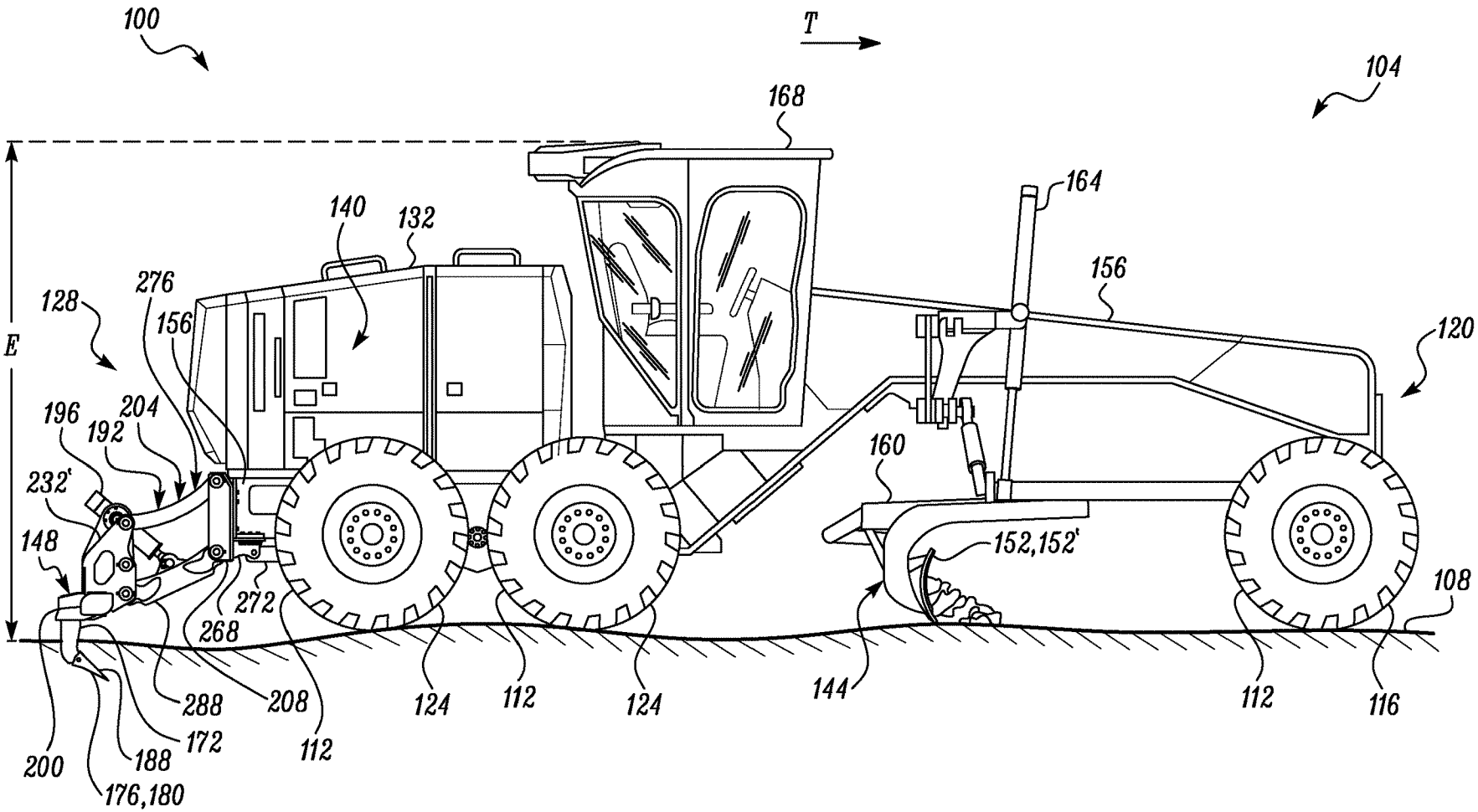
FIG. 1 is a side view of an exemplary grading machine having a frame and an implement assembly coupled to the frame, in accordance with one or more aspects of the present disclosure.
Figure 2:
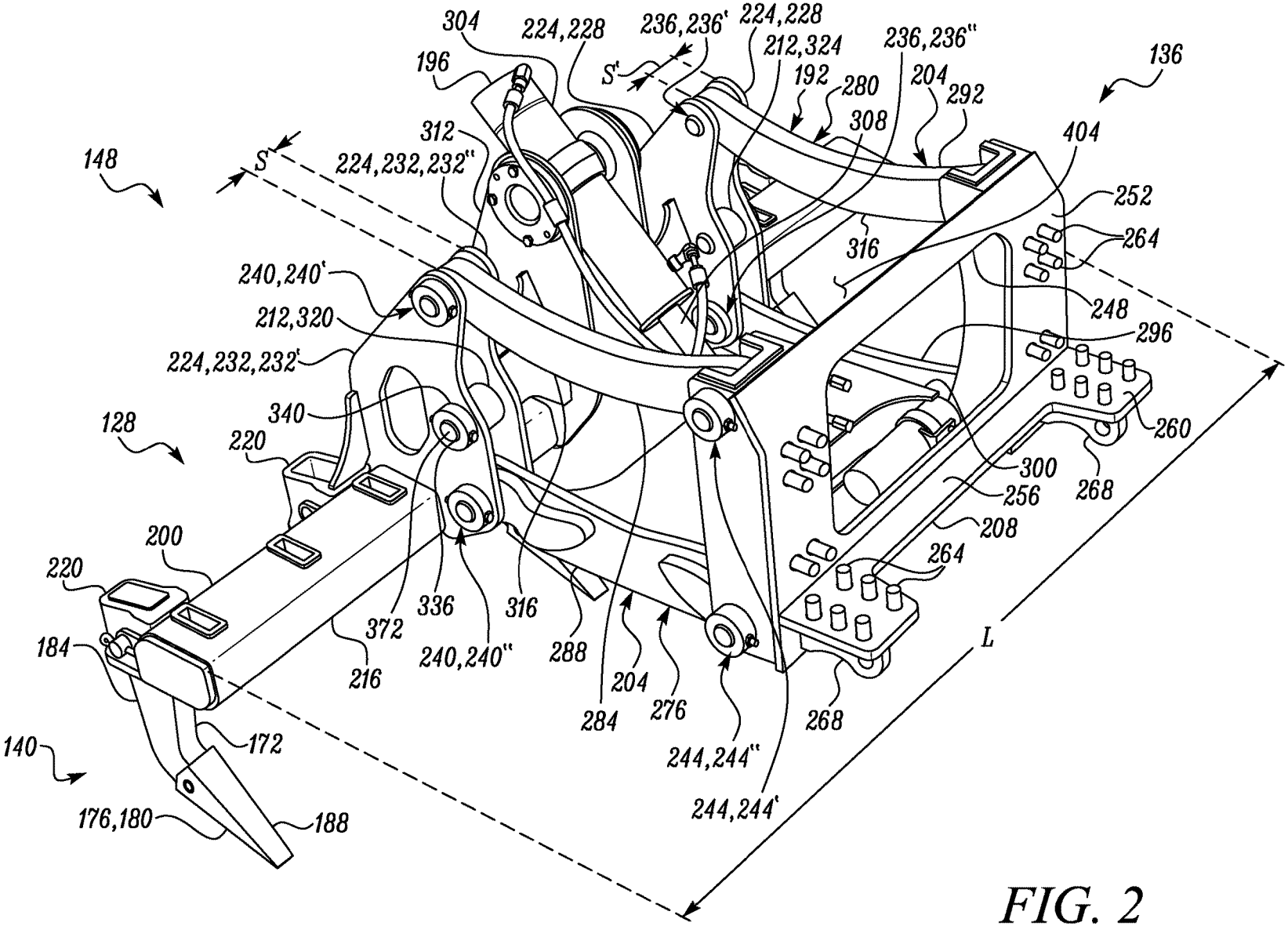
FIG. 2 is a perspective view of the implement assembly having an implement, a linkage to couple the implement to the frame, and one or more bump stops, in accordance with one or more aspects of the present disclosure.

Referring to FIGS. 1 and 2, a machine 100, such as a grader machine 104, is described. The machine 100 may be used to perform functions, such as earth altering functions, including displacing, spreading, distributing, leveling, and grading materials, such as soil, over a ground surface or a work surface 108. Generally, a grading operation may be performed during machine movement, and for this purpose, the machine 100 may include traction devices 112 that may facilitate machine movement over the work surface 108. For example, the traction devices 112 may include a set of front wheels 116 disposed towards a front end 120 of the machine 100 and a set of rear wheels 124 disposed towards a rear end 128 of the machine 100. A movement of the traction devices 112 (e.g., a rotation of the set of front wheels 116 and set of rear wheels 124) may be powered by a power source, such as an engine (not shown), housed within a power compartment 132 of the machine 100. The machine 100 may also define a left side 136 and a right side 140 (also see FIG. 2).

The terms 'front', 'forward' and 'rear', rearward, and the like terms, as used in the present disclosure, are in relation to an exemplary direction of travel of the machine 100, as represented by arrow, T, in FIG. 1, with said direction of travel being exemplarily defined from the rear end 128 towards the front end 120. Similar description may be applied for understanding the terms 'left' and 'right', as one may view the machine 100 in and along a direction from the rear end 128 to the front end 120, or, in other words, a direction which is defined along the direction, T. Any part or system of the machine 100 referenced with the term 'left' may mean that said part or system is either at the left side 136 of the machine 100 or positioned relatively towards the left side 136 of the machine 100. Similarly, any part or system of the machine 100 referenced with the term 'right' may mean that said part or system is either at the right side 140 of the machine 100 or positioned relatively towards the right side 140 of the machine 100.

The machine 100 may include one or more implement assemblies, e.g., a front implement assembly 144 and a rear implement assembly 148. The front implement assembly 144 may be mounted towards the front end 120 of the machine 100. The front implement assembly 144 may include a front implement 152 which may include a blade 152 (e.g., a moldboard). The blade 152' may perform one or more of the aforesaid earth altering functions. The blade 152' may be supported under a frame 156 of the machine 100. As an example, the blade 152' may be mounted on a blade tilt adjustment mechanism of a drawbar-circle-blade (DCB) arrangement 160 of the machine 100. Further, a variety of actuators, e.g., a hydraulic actuator 164, may be provided for controlling a position of the blade 152 with respect to the frame 156. Details related to the blade 152' and its working may be contemplated by someone in the art and shall not be further discussed. Further, the machine 100 may also include an operator cab 168 mounted to the frame 156, and which may house various controls, e.g., for the power source of the machine 100 and/or for operating the front implement assembly 144 and the rear implement assembly 148 of the machine 100.

The rear implement assembly 148 may be coupled to and supported on the frame 156 and may be located towards the rear end 128 to form the rear end 128 of the machine 100. As with the front implement assembly 144, the rear implement assembly 148 may also include a rear implement 172, and which may be applied to alter earth during machine movement. In one example, and also as exemplarily shown, the rear implement 172 may include a ripper set 176 including one or more ripper blades 180. Each of the ripper blades 180 may exemplarily include a shank portion 184 and a blade tip portion 188 coupled or integrally extending from the shank portion 184. During operations of the machine 100 and/or machine movement, the blade tip portion 188 may engage with the work surface 108 to break and/or loosen the work surface 108 in order to alter the work surface 108. Apart from the rear implement 172 and/or the ripper set 176, the rear implement assembly 148 may also include a linkage 192 and an actuator 196, as shown.

The linkage 192 may be used to move the rear implement 172 or the ripper set 176 between a working state and a stowed state with respect to the frame 156 of the machine 100. The working state of the rear implement 172 may be applicable during operations of the machine 100 (e.g., during machine movement) so as to alter the work surface 108, while the stowed state of the rear implement 172 may be applicable when the machine 100 is non-operational and/or when an alteration of the work surface 108 is not needed (e.g., when the machine 100 is stationary or tramming between various locations of a worksite). The linkage 192 may include multiple parts and components—e.g., the linkage 192 may include a carriage 200, arm assemblies 204, a mounting unit 208, and one or more bump stops 212, details related each of which shall be discussed below.

The carriage 200 may be applied to support the rear implement 172 or the ripper set 176. In this regard, the carriage 200 may include a generally elongated member 216 which may define or be configured with a number of attachment regions 220 to which the rear implement 172, e.g., the ripper blades 180 (or the shank portion 184 of the ripper blades 180) may be removably and correspondingly mounted. As an example, the elongated member 216 may include anywhere between 5 (five) to 7 (seven) attachment regions 220 to which an equal number of ripper blades 180 (e.g., 5 (five) to 7 (seven) ripper blades) may be attached such that the ripper blades 180 can be coupled to the elongated member 216. A higher or lesser number of attachment regions 220 can be provided so as to correspondingly attach a higher or lesser number of ripper blades 180 onto the elongated member 216 of the carriage 200. Further, it may be noted that not all attachment regions 220 of the carriage 200 may necessarily include a ripper blade 180 mounted thereto and some attachment regions 220 may remain empty or devoid of a ripper blade 180.

In some embodiments, the carriage 200 may include a number of plates 224. The plates 224 may be structured and arranged on and along a length, L, of the elongated member 216. The plates 224 may be exemplarily 4 (four) in number and may be arranged serially on the elongated member 216. In one example, the plates 224 may be arranged in the form of pairs and may include a pair of left side plates 228 which may be defined towards the left side 136 of the machine 100 and a pair of right side plates 232 which may be defined towards the right side 140 of the machine 100. Although not limited, each of the pair of left side plates 228 and the pair of right side plates 232 may extend uprightly or orthogonally with respect to the length, L, of the elongated member 216, as shown. Further, the pair of left side plates 228 and the pair of right side plates 232 may define coupling regions. For example, the pair of left side plates 228, in conjunction with each other, may define a pair of left side coupling portions 236, and, similarly, the pair of right side plates 232, in conjunction with each other, may define a pair of right side coupling portions 240.

Also, each of the pair of left side coupling portions 236 and the pair of right side coupling portions 240 may be defined along an elevation, E, e.g., an elevation, E, of the machine 100 (see FIG. 1). In so doing, for the pair of left side coupling portions 236, one coupling portion 236' may be located above the other coupling portion 236", and, similarly, for the pair of right side coupling portions 240, one coupling portion 240' may be located above the other coupling portion 240". In some embodiments, the pair of left side plates 228 and the pair of right side plates 232 may be part of the same unit or structure, and thus may be integrally formed with each other. For the purposes of the present disclosure, the plates forming the pair of right side plates 232 may be respectively annotated and referred to as a first plate 232' and a second plate 232".

The mounting unit 208 may be configured to secure the rear implement assembly 148 to the frame 156 of machine 100. The mounting unit 208 may define a pair of right side connection regions 244 and pair of left side connection regions (not shown). The pair of left side connection regions may be similar to the pair of right side connection regions 244. Further, the mounting unit 208 may also define an opening 248 in between the pair of right side connection regions 244 and the pair of left side connection regions. Each of the pair of right side connection regions 244 and the pair of left side connection regions may be defined along the elevation, E, of the machine 100. In so doing, for the pair of right side connection regions 244, one connection region 244' may be located above the other connection region 244" along the elevation, E. Similar description may be contemplated for the pair of left side connection regions as well (not shown).

The mounting unit 208 may also include a forward facing bracket 252. The forward facing bracket 252 may define a vertical surface 256 and a horizontal surface 260. Each of the vertical surface 256 and horizontal surface 260 may be applied to engage a portion of the frame 156 of the machine 100 in order to be secured to the frame 156 of the machine 100 and in order to mount (e.g., fixedly mount) the linkage 192 and thus the rear implement assembly 148 to the frame 156 of the machine 100. As an example, an engagement and/or a securement between the rear implement assembly 148 and the frame 156 may be attained by use of fasteners 264 (see few fasteners 264 marked in FIG. 2). The fasteners 264 may include threaded fasteners, such as bolts, and may extend between the forward facing bracket 252 and the frame 156 of the machine 100 to attain the engagement and/or securement between the rear implement assembly 148 and the frame 156.

In some embodiments, the rear implement assembly 148 or the mounting unit 208 may also include a pair of underside connection portions 268. In this regard, the rear implement assembly 148 may include a pair of tag links 272 (see FIG. 1) that may extend forward from the underside connection portions 268 to assist in securing the rear implement assembly 148 to a portion of the machine 100 or to the frame 156 of the machine 100. Each of the tag links 272 may exemplarily include an elongated arm (e.g., see elongated arm as shown in FIG. 1) that may be coupled to the corresponding underside connection portion (of the pair of underside connection portions 268) and to the frame 156 or to another part or component of the machine 100, which may be located forward or ahead of the rear implement assembly 148.

The arm assemblies 204 may correspond to a first arm assembly 276 and a second arm assembly 280. The first arm assembly 276 may be located towards the right side 140 of the machine 100 and may include a first arm 284 and a second arm 288, as shown. The second arm assembly 280 may be located towards the left side 136 of the machine 100 and may include a third arm 292 and a fourth arm 296, as shown. The first arm 284 and the second arm 288 may be pivotably and correspondingly coupled to the pair of right side connection regions 244 of the mounting unit 208 and the first arm 284 may be located at an elevation (e.g., along the elevation, E) with respect to the second arm 288. Similarly, the third arm 292 and the fourth arm 296 may be pivotably and correspondingly coupled to the pair of left side connection regions (not shown) of the mounting unit 208 and the third arm 292 may be located at an elevation (e.g., along the elevation, E) with respect to the fourth arm 296. By way of such coupling, each of the first arm assembly 276 and the second arm assembly 280 may be pivotably coupled to the mounting unit 208.

Further, the first arm assembly 276 and the second arm assembly 280, e.g., each of the first arm 284, the second arm 288, the third arm 292, and the fourth arm 296, may also be pivotably and correspondingly coupled to the carriage 200, e.g., to the plates 224 structured and arranged on the elongated member 216 of the carriage 200. In this regard, the first arm 284 and the second arm 288 may be rotatably and correspondingly coupled to the pair of right side coupling portions 240 defined by the pair of right side plates 232 and the third arm 292 and the fourth arm 296 may be rotatably and correspondingly coupled to the pair of left side coupling portions 236 defined by the pair of left side plates 228. In that manner, the first arm assembly 276 and the second arm assembly 280 may be pivotable with respect to the carriage 200.

Also, it may be noted that the first arm 284 and the second arm 288 may be coupled and supported within a space, S, defined between the pair of right side plates 232, while the third arm 292 and the fourth arm 296 may be coupled and supported within a space, S", defined between the pair of left side plates 228. Such manner of coupling and support may be contemplated by someone in the art and thus will not be discussed further. In some embodiments, a platform 300 may be fixedly coupled to the second arm 288 and the fourth arm 296 and thus may extend between the second arm 288 and the fourth arm 296.

The actuator 196 may be provided to control a working of the linkage 192 and switch a state of the rear implement 172 or the ripper set 176. In general, the actuator 196 may be configured to switch between an extended position and a retracted position and may accordingly allow the rear implement 172 or the ripper set 176 to be moved between the working state and the stowed state with respect to the frame 156.

As an example, the actuator 196 may include a hydraulic actuator and may exemplarily define a cylinder portion 304 and a rod portion 308. The cylinder portion 304 may be pivotably coupled to a section of the carriage 200 (e.g., to a tower section 312 of the carriage 200 which may exemplarily extend oppositely to the blade tip portion 188 of the ripper blades 180) while the rod portion 308 may be pivotably coupled to the platform 300. A switching of the actuator 196 to the extended position may cause the rear implement 172 to be moved to the stowed state, while a switching of the actuator 196 to the retracted position may cause the rear implement 172 to be moved to the working state. The position attained by the rear implement 172 or the ripper set 176 in the stowed state may be higher along the elevation, E, than a position attained by the rear implement 172 or the ripper set 176 in the working state (compare positions of the rear implement 172 in FIGS. 1 and 4).

It will be appreciated that the arrangement of the arm assemblies 204 (e.g., the first arm assembly 276 and the second arm assembly 280) in between the mounting unit 208 and the carriage 200 imparts a generally parallelogram shaped configuration to the arm assemblies 204. In so doing, as the actuator 196 may be switched to the extended position to move the rear implement 172 to the stowed state, portions 316 (e.g., mid portions) of the first arm 284 and the third arm 292 may pivot towards the carriage 200 (see configuration of the linkage 192 in FIG. 4) and correspondingly towards the pair of right side plates 232 and the pair of left side plates 228 of the carriage 200 to come correspondingly and relatively close to the pair of right side plates 232 and the pair of left side plates 228. Conversely, as the actuator 196 may be switched to the retracted position to move the rear implement 172 to the working state, portions 316 (e.g., the mid portions) of the first arm 284 and the third arm 292 may pivot outwards (or away) (see configuration of the linkage 192 in FIG. 1) from the carriage 200 and may correspondingly move away from the pair of right side plates 232 and the pair of left side plates 228.

The bump stops 212 may be exemplarily 2 (two) in number—e.g., a first bump stop 320 and a second bump stop 324. The bump stops 212 (e.g., the first bump stop 320 and the second bump stop 324) may be used to contact respective arms (e.g., the first arm 284 and the third arm 292) in the stowed state of the rear implement 172 to isolate impact stress away from the frame 156 and onto the linkage 192 (e.g., onto the first arm 284 and third arm 292 of the linkage 192). In this regard, it may be noted that impact stresses may arise from forces acting on the rear implement 172, e.g., reactionary forces arising from the operation of the rear implement 172 as the rear implement 172 may contact the work surface 108 or forces associated with a movement of the rear implement 172 to the stowed state (e.g., from the working state).

More particularly, when the rear implement 172 moves to the stowed state (e.g., by switching the actuator 196 to the extended position or because of forces of operation in the working state), each of the first bump stop 320 and the second bump stop 324 may respectively contact the portions 316 (e.g., the mid portions) of the first arm 284 and the third arm 292 as said portions 316 (e.g., the mid portions) of the first arm 284 and the third arm 292 come correspondingly and relatively close with respect to the pair of right side plates 232 and the pair of left side plates 228 of the carriage 200.

In this regard, the first bump stop 320 and the second bump stop 324 may be coupled (e.g., fixedly coupled) to the carriage 200. To this end, it may be noted that the first bump stop 320 may be positioned in between the pair of right side plates 232 and the second bump stop 324 may be positioned in between the pair of left side plates 228—exemplary discussions related to the coupling of the first bump stop 320 and the second bump stop 324 to the carriage 200 have been provided below.

Figure 3:
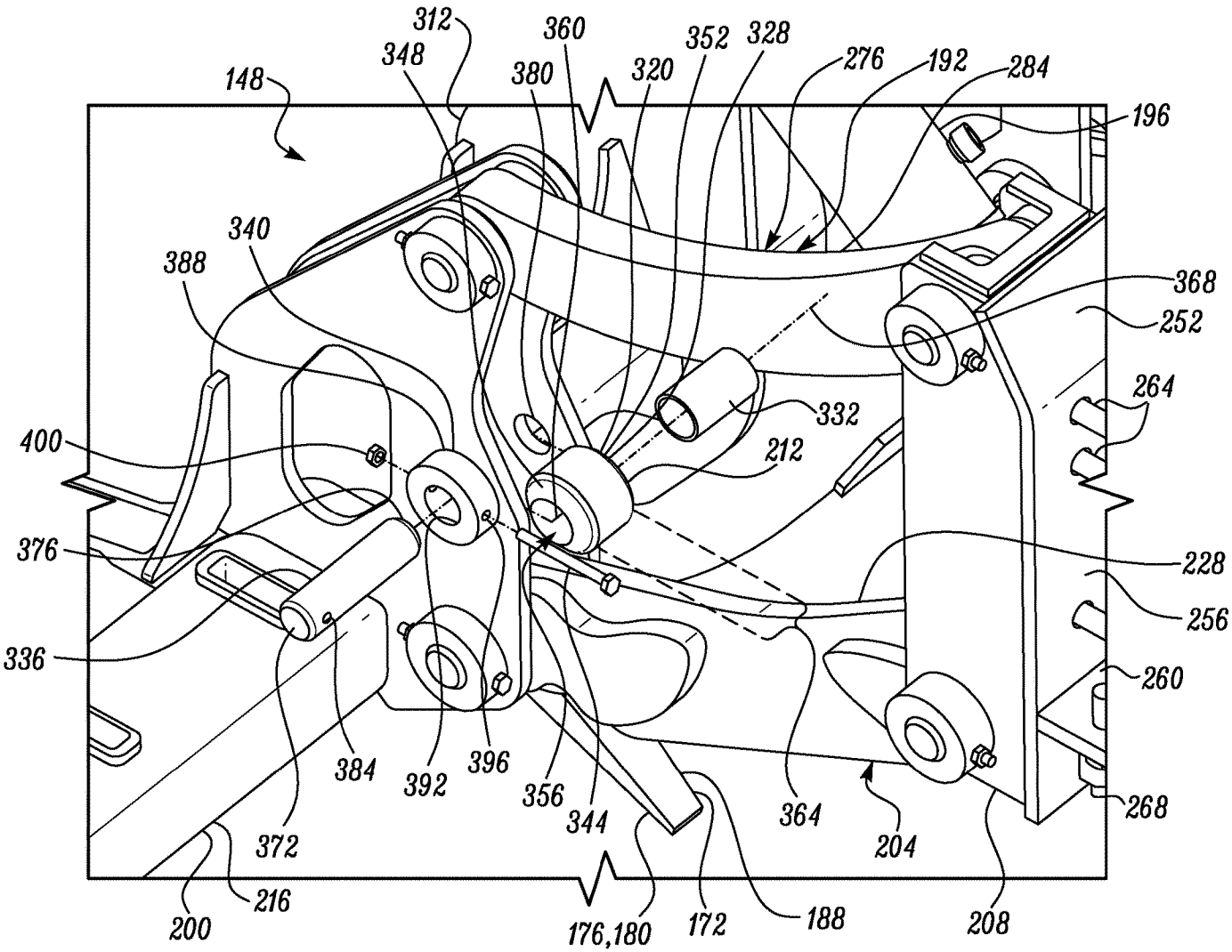
FIG. 3 is a close-up perspective view of a portion of the implement assembly illustrating one of the bump stops in an exploded view, in accordance with one or more aspects of the present disclosure.

Referring now to FIG. 3, each of the first bump stop 320 and the second bump stop 324 may include a bump stop piece 328, a sleeve 332, and a support pin 336. Further, each of the first bump stop 320 and the second bump stop 324 may also include a retainer 340 and a retainer stud 344. Discussions below may be mainly focused towards the first bump stop 320 and the pair of right side plates 232, but similar and/or equivalent discussions may be contemplated for the second bump stop 324 and the pair of left side plates 228, as well.

The bump stop piece 328 may include a cylindrical structure defining a first axial end 348 and a second axial end 352. Further, the bump stop piece 328 may define a through hole 356 extending between the first axial end 348 and the second axial end 352. The through hole 356 may define a through hole axis 360. Although not limited, the bump stop piece 328 may define an intermediate segment 364 between the first axial end 348 and the second axial end 352 defining a maximum cross-sectional area of the bump stop piece 328. In some embodiments, the first axial end 348 and the second axial end 352 may define a minimum cross-sectional area of the bump stop piece 328. In some embodiments, the cross-sectional areas of the first axial end 348 and the second axial end 352 may be the same. Also, the bump stop piece 328 may be made from a resilient material, thus making each of the first bump stop 320 and the second bump stop 324 resilient bump stops, and which may be made from one or more of rubber, ebonite, polyurethane, or mild steel.

The sleeve 332 may be inserted into the through hole 356 defined by the bump stop piece 328. The sleeve 332 may be cylindrically shaped and may define a sleeve axis 368. The sleeve 332 may be disposed in and along the through hole 356 such that the sleeve axis 368 can fall in alignment with the through hole axis 360. The sleeve 332 may be formed from a metallic material or from a non-metallic material, which may include a high grade and/or a high strength plastic or polymer.

Further, the support pin 336 may be passed through the sleeve 332, such that ends (see first pin end 372 and second pin end 376 in FIG. 3) of the support pin 336 may be disposed relatively outwardly of the bump stop piece 328 and the sleeve 332. The first pin end 372 and the second pin end 376 may be received correspondingly into apertures provided in each plate of the pair of right side plates 232 (e.g., see aperture 380 provided for the second plate 232") (for ease of reference and understanding, same reference numeral, i.e., '380', may be used to refer to the aperture 380 for the first plate 232') such that the support pin 336 may be supported between the pair of right side plates 232.

Moreover, because the bump stop piece 328 may be supported around the support pin 336, the support pin 336 may in turn support and also retain the bump stop piece 328 within the space, S, defined between the pair of right side plates 232, e.g., between the first plate 232' and the second plate 232" of the pair of right side plates 232 while also being supported around the support pin 336. Moreover, the first pin end 372 and second pin end 376 of the support pin 336 may extend outwards of one of the plates of the pair of right side plates 232, e.g., see first pin end 372 of the support pin 336 extended outwards of the first plate 232' (best visualized in FIG. 2). The first pin end 372 of the support pin 336 may also define a channel 384, which may be a through channel.

The retainer 340 may be disc shaped member and may define an annular body 388 with a slot 392. The retainer 340 may be fixedly coupled (e.g., by welding or by other fastening means now known or in the future developed) to one of the plates of the pair of right side plates 232 (e.g., to the first plate 232') such that the slot 392 can be aligned with the aperture 380 of the first plate 232'. The slot 392 may receive the first pin end 372 of the support pin 336 extended outwardly of the aperture 380 of the first plate 232'. Further, the retainer 340 may define a groove 396, which may exemplarily pass diametrically through and across the annular body 388 of the retainer 340. When the first pin end 372 of the support pin 336 may be received into the slot 392, the groove 396 and the channel 384 (formed in the first pin end 372 of the support pin 336) may be aligned with respect to each other to permit a passage of the retainer stud 344 through each of the groove 396 and the channel 384. In that manner, the support pin 336 may be retained (e.g., immovably) with respect to the retainer 340 and the pair of right side plates 232. The retainer stud 344 itself may be retained with the annular body 388 of the retainer 340 by way of a nut 400.

INDUSTRIAL APPLICABILITY

During an assembly of the first bump stop 320 to the pair of right side plates 232, e.g., the first plate 232' and the second plate 232", an operator may first couple (e.g., by welding or by other fastening means now known or in the future developed) the retainer 340 to the first plate 232'. In so doing, the slot 392 defined by the annular body 388 of the retainer 340 may be aligned with the aperture 380 in the first plate 232' (see aperture 380 in the second plate 232" for reference). Thereafter, the operator may slide the sleeve 332 into the through hole 356 of the bump stop piece 328 such that the sleeve 332 may be assembled within the through hole 356 and such that the sleeve axis 368 may be aligned with the through hole axis 360.

Next, the operator may insert the assembly of the bump stop piece 328 and the sleeve 332 into the space, S, defined between the first plate 232' and the second plate 232" such that the through hole axis 360 or the sleeve axis 368 may be aligned with each of the apertures 380 defined in the pair of right side plates 232. Once such an alignment is attained, the operator may insert the support pin 336 through the apertures and through the assembly of the bump stop piece 328 and the sleeve 332. The insertion of the support pin 336 may be such that the first pin end 372 may be received into and be positioned within the slot 392 of the annular body 388 of the retainer 340.

As the first pin end 372 is received within the slot 392 of the annular body 388 of the retainer 340, the operator may turn the support pin 336, as needed, within the slot 392 such that the channel 384 formed within the first pin end 372 may be aligned with the groove 396 defined by the annular body 388 of the retainer 340. Upon an alignment of the channel 384 with the groove 396, the operator may insert the retainer stud 344 through and across the groove 396 and the channel 384. In order to retain the support pin 336 with the retainer 340 and to keep the retainer stud 344 from misplacements or loosening from the retainer 340, the operator may use the nut 400 to engage the nut 400 against a portion of the retainer stud 344 such that the retainer stud 344 can be locked in place with the retainer 340 and the support pin 336.

With the retainer stud 344 engaging the retainer 340 and the support pin 336, the support pin 336 can be maintained immovably with respect to each of the slot 392 and the apertures in the first plate 232' and the second plate 232", and also with the assembly of the bump stop piece 328 and the sleeve 332. In that manner, the support pin 336 may support the bump stop piece 328 within the space, S, defined in between the first plate 232' and the second plate 232" of the pair of right side plates 232. Moreover, the support pin 336 is secured to the carriage 200 to couple the corresponding bump stop (e.g., the first bump stop 320) to the carriage 200. It will be appreciated that the second bump stop 324 may be coupled to the pair of left side plates 228 in a similar manner as a coupling to the pair of right side plates 232 has been described above for the first bump stop 320.

Figure 4:
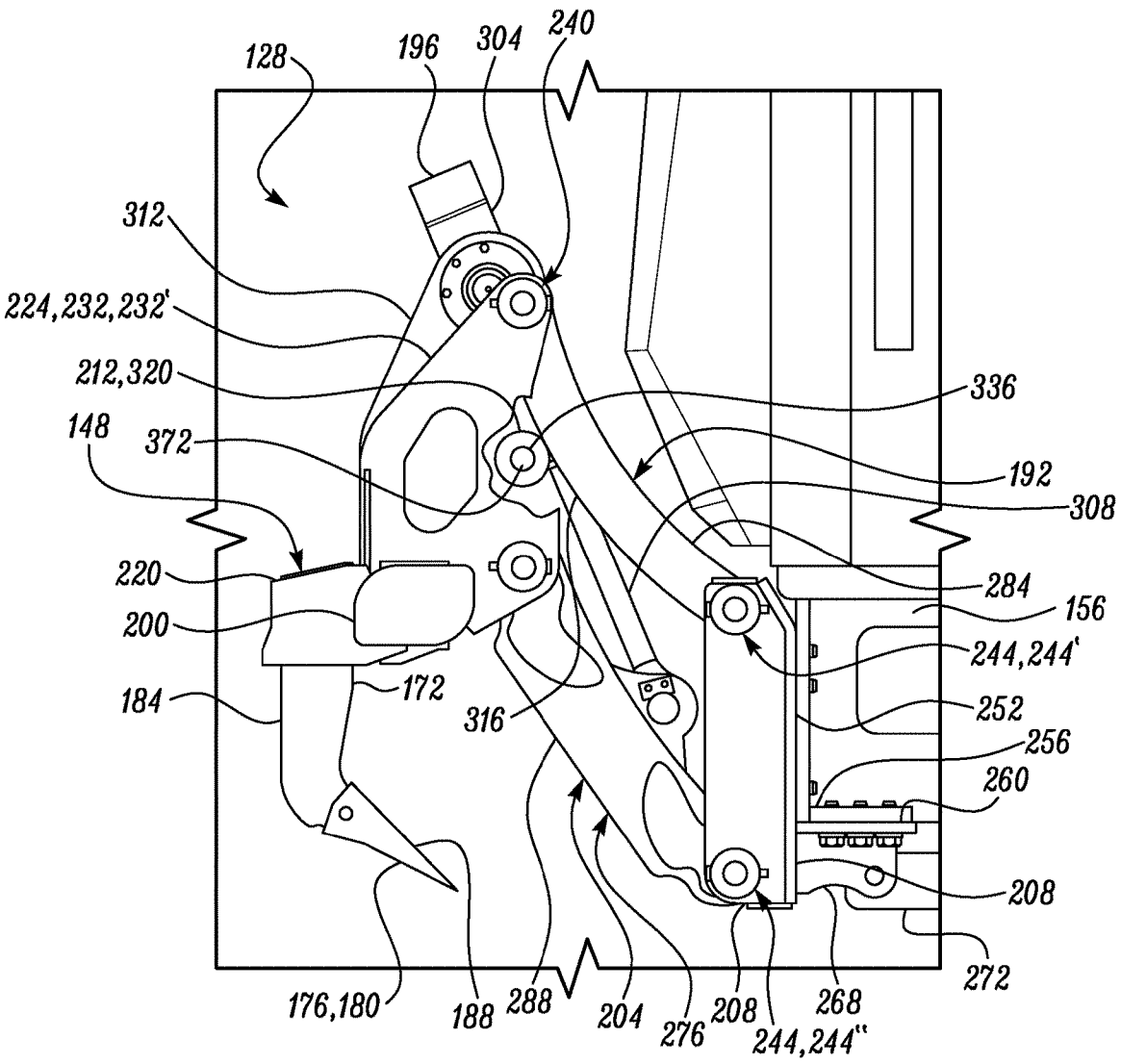
FIG. 4 is a close-up view of the implement assembly in a stowed state illustrating the one of the bump stops in contact with an arm of the linkage, in accordance with one or more aspects of the present disclosure.

During operations, and also referring to FIG. 4, the rear implement 172 may be in the working state. As various forces may act on the rear implement 172, such as reactionary forces or impact stresses arising from the operation of the rear implement 172 (e.g., owing to an engagement of the blade tip portion 188 with the work surface 108) and/or forces arising from the switching of the actuator 196 to the extended position. (e.g., from the retracted position), and because each of the first arm assembly 276 and the second arm assembly 280 is coupled to the carriage 200 and pivotable with respect to the carriage 200 to move the rear implement 172 to the stowed state, the rear implement 172 may move or be urged (e.g., from the working state) towards the stowed state.

As the rear implement 172 moves towards the stowed state, portions 316 (e.g., mid portions) of the first arm 284 and the third arm 292 may pivot towards the carriage 200 and correspondingly towards the pair of right side plates 232 and the pair of left side plates 228 of the carriage 200. Because the first bump stop 320 and the second bump stop 324 may be positioned correspondingly in between the pair of right side plates 232 and the pair of left side plates 228, the first bump stop 320 and the second bump stop 324 may correspondingly contact (and in some cases be compressed against) the portions 316 (e.g., mid portions) of the respective arms, e.g., the first arm 284 and the third arm 292, as the rear implement 172 moves towards or attains the stowed state.

In that manner, a significant component of forces, as noted above, may be transferred to the arm assemblies 204 (e.g., the first arm assembly 276 and the second arm assembly 280) of the machine 100 thus localizing impact stresses within the linkage 192 or parts of the rear implement assembly 148 and mitigating force transfer to or through other parts of the machine 100, such as the frame 156 or the tag links 272 of the machine 100. Accordingly, impact stress during operations is isolated away from the frame 156 and onto the linkage 192 or onto the first arm 284 and third arm 292 of the linkage 192. Also, it may be noted that the contact between the first bump stop 320 and the second bump stop 324 with the portions 316 of the first arm 284 and the third arm 292 may limit, in the stowed state, further movement of the rear implement 172 towards the stowed state. As a result of force transfer to the first arm 284 and the third arm 292, no or negligible structural stresses are developed and/or induced in other surrounding parts of the machine 100, such as the frame 156 of the machine 100, thus prolonging their useful life and improving their durability.

Moreover, with the first bump stop 320 and the second bump stop 324 interacting with the first arm 284 and the third arm 292, a zone 404 defined within the linkage 192 may be relieved and freed up. This makes it relatively easy to access the opening 248 and/or to install and/or remove any component or device into or from the machine 100 through the opening 248.

The term "coupled" as employed herein is used broadly and encompasses both direct and indirect connections between two components-direct meaning at least portions of the two components are in contact with one another, possibly with the use of fasteners or fastening material, and indirect meaning at least portions of the two components are in contact with at least portions of at least one intermediate structure therebetween, possibly with the use of fasteners or fastening material.

Unless explicitly excluded, the use of the singular to describe a component, structure, or operation does not exclude the use of plural such components, structures, or operations or their equivalents. The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B; A, A and B; A, B and B), unless otherwise indicated herein or clearly contradicted by context. Similarly, as used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

It will be apparent to those skilled in the art that various modifications and variations can be made to the method and/or system of the present disclosure without departing from the scope of the disclosure. Other embodiments will be apparent to those skilled in the art from consideration of the specification and practice of the method and/or system disclosed herein. It is intended that the specification and examples be considered as exemplary only, with a true scope of the disclosure being indicated by the following claims and their equivalent.

What is claimed is:

1. A linkage for moving an implement between a working state and a stowed state with respect to a frame of a machine, the linkage comprising:

a carriage to support the implement;

at least one arm assembly coupled to the carriage and pivotable with respect to the carriage to move the implement to the stowed state; and one or more bump stops configured to contact an arm of the at least one arm assembly in the stowed state of the implement to isolate impact stress away from the frame and onto the linkage;

wherein the one or more bump stops are coupled to the carriage.

2. The linkage of claim 1, wherein each bump stop of the one or more bump stops includes a bump stop piece, a sleeve inserted into the bump stop piece, and a pin passing through the sleeve, wherein the pin is secured to the carriage to couple the corresponding bump stop to the carriage.

3. The linkage of claim 2, wherein the carriage includes a plurality of plates, and the pin is supported between at least two plates of the plurality of plates to retain the bump stop piece within a space defined between the at least two plates.

4. The linkage of claim 3, wherein the arm of the at least one arm assembly is supported within the space, the arm being rotatably coupled to the at least two plates to enable the at least one arm assembly to be pivotable with respect to the carriage.

5. The linkage of claim 1, wherein the at least one arm assembly corresponds to a first arm assembly and a second arm assembly, and the linkage further includes a mounting unit configured to be secured to the frame of the machine, each of the first arm assembly and the second arm assembly being pivotably coupled to the mounting unit.

6. The linkage of claim 5, wherein the arm of the at least one arm assembly is a first arm of the first arm assembly, the first arm assembly further including a second arm, wherein the first arm and the second arm are positioned one above the other along an elevation.

7. The linkage of claim 6, wherein a position attained by the implement in the stowed state is higher along the elevation than a position attained by the implement in the working state.

8. The linkage of claim 1, wherein the one or more bump stops correspond to one or more resilient bump stops.

9. The linkage of claim 1, wherein the one or more bump stops are made from one or more of rubber, ebonite, polyurethane, or mild steel.

10. The linkage of claim 1, wherein the one or more bump stops are directly coupled to the carriage.

11. A machine, comprising:

a frame;

an implement coupled to the frame;

a linkage for moving the implement between a working state and a stowed state with respect to the frame, the linkage including:

a carriage to support the implement;

a first arm assembly and a second arm assembly, each of the first arm assembly and the second arm assembly being coupled to the carriage and pivotable with respect to the carriage to move the linkage to the stowed state; and a pair of bump stops configured to be in contact between the carriage and respective arms of the first arm assembly and the second arm assembly to limit, in the stowed state, further movement of the implement towards the stowed state.

12. The machine of claim 11, wherein the pair of bump stops are coupled to the carriage.

13. The machine of claim 12, wherein each bump stop of the pair of bump stops includes a bump stop piece, a sleeve inserted into the bump stop piece, and a pin passing through the sleeve, wherein the pin is secured to the carriage to couple the corresponding bump stop to the carriage.

14. The machine of claim 13, wherein the carriage includes a plurality of plates, and the pin is supported between at least two plates of the plurality of plates to retain the bump stop piece within a space defined between the at least two plates.

15. The machine of claim 14, wherein the arms of the first arm assembly and the second arm assembly are supported within the space, the arms being rotatably coupled to the at least two plates to enable the first arm assembly and the second arm assembly to be pivotable with respect to the carriage.

16. The machine of claim 11, wherein the linkage further includes a mounting unit configured to be secured to the frame of the machine, each of the first arm assembly and the second arm assembly being pivotably coupled to the mounting unit.

17. The machine of claim 11, wherein the first arm assembly includes a first arm and a second arm and the second arm assembly includes a third arm and a fourth arm, the first arm and the second arm being positioned one above the other along an elevation and the third arm and the fourth arm being positioned one above the other along an elevation.

18. The machine of claim 17, wherein a position attained by the implement in the stowed state is higher along the elevation than a position attained by the implement in the working state.

19. The machine of claim 11, wherein the pair of bump stops corresponds to a pair of resilient bump stops.

20. The machine of claim 11, wherein the pair of bump stops are made from one or more of rubber, ebonite, polyurethane, or mild steel.

* * * * *